United States Patent [19]

Anderson

[11] Patent Number: 4,480,695

[45] Date of Patent: Nov. 6, 1984

[54] METHOD OF ASSISTING SURFACE LIFT OF HEATED SUBSURFACE VISCOUS PETROLEUM

[75] Inventor: Donald J. Anderson, Newport Beach, Calif.

[73] Assignee: Chevron Research Company, San Francisco, Calif.

[21] Appl. No.: 413,326

[22] Filed: Aug. 31, 1982

[51] Int. Cl.[3] ..... E21B 43/24

[52] U.S. Cl. ..... 166/303; 166/50; 166/250

[58] Field of Search ..... 166/303, 250, 50; 299/2, 5

[56] References Cited

U.S. PATENT DOCUMENTS

| | | | |
|---|---|---|---|
| 2,991,987 | 7/1961 | Heinze | 166/303 |
| 4,109,715 | 8/1978 | Adamson | 299/5 |
| 4,116,275 | 9/1978 | Butler et al. | 166/303 |
| 4,362,213 | 12/1982 | Taber | 166/303 |

*Primary Examiner*—Stephen J. Novosad

*Assistant Examiner*—Mark J. Del Signore

*Attorney, Agent, or Firm*—G. W. Wasson; Lewis S. Gruber; Edward J. Keeling

[57] ABSTRACT

A method and apparatus is described for producing viscous petroleum from a subsurface formation. The apparatus includes a generally horizontal cased well through the subsurface formation with injection and production tubings within the well. The casing is perforated and the inner tubings carry a movable packer and a rotatable agitator. The method comprises injecting a heating and drive fluid for moving heated viscous petroleum through the perforations in the casing and into the well for production to the wellhead. Production is monitored for the ratio of produced packer fluid and viscous petroleum. Based on that ratio, the packer is moved within the casing to positions along the horizontal well to maximize production of petroleum. The rotatable agitator assists in removal from the well bore of formation solids produced with the viscous petroleum.

5 Claims, 3 Drawing Figures

METHOD OF ASSISTING SURFACE LIFT OF HEATED SUBSURFACE VISCOUS PETROLEUM

BACKGROUND OF THE INVENTION

This invention relates to recovering viscous petroleum from petroleum-containing formations. Throughout the world there are many deposits of high-viscosity crude petroleum in subsurface formations; some of these deposits are referred to as oil sands. In general, the crude petroleum in these deposits is not recoverable in its natural state through a well by ordinary production methods because there is insufficient or non-existent natural drive mechanisms to cause the petroleum to flow into a well.

There have been many in-situ well-to-well pilots proposed for shallow deposits of oil sands, all of which used some form of thermal stimulation after establishing communication between an injector well and a producer well. Many processes have been utilized in attempting to recover viscous petroleum from viscous oil formations of the Athabasca Tar Sands type, including the application of heat to such viscous petroleum formations by steam or underground combustion. The use of vertical slotted liners positioned in the viscous oil formation as a conduit for hot injection fluids has also been suggested; however, most of these methods have not been overly successful because of the difficulty of establishing and maintaining communication between an injector well and a producer well. Clearly, if one could eliminate the need to establish and maintain communication between an injector well and a producer well, regardless of the drive fluid or recovery technique employed, many of these viscous petroleum deposits could become potentially successful projects. Further, techniques are needed to assist in lifting the produced viscous petroleum to the wellhead and for clearing from the well formation solids produced with the viscous petroleum.

BRIEF DESCRIPTION OF THE INVENTION

The present invention is directed to a method of assisting the recovery of viscous petroleum from a petroleum-containing formation and is particularly useful in those formations where communication between an injector and a producer is difficult to establish and maintain. A hole is formed through the petroleum-containing formation and a generally horizontal, tubular pair of concentric conductors is inserted into the hole to provide a continuous, uninterrupted flow path from the wellhead through the generally horizontal tubular members in the formation and back to the wellhead. A hot fluid is flowed through the inner tubular member, returning to the surface via the annulus to heat viscous petroleum in the formation outside the outer tubular member to reduce the viscosity of at least a portion of the petroleum adjacent the outside of the outer tubular member with the intention of establishing a potential passage for fluid flow through the formation adjacent the outside of the tubular member. Alternatively, the hot fluid flow may be reversed by injecting down the annulus and returning to the surface through the inner tubular member.

The outer conductor of the tubular member may initially be perforated in the zone where recovery of the viscous petroleum is desired or the tubular member may be subsequently perforated to provide passage ways between the formation and the tubular member.

After the viscous petroleum has been heated to become mobile, the lower portion of the tubular member is isolated from the fluid flow and opened to production of the heated petroleum. A diverter, for example, a movable packer, is placed within the tubular member between the inner and outer conductor to cause the hot fluid to pass out through the perforations into the formation, there acting as a drive fluid to force the heated petroleum toward the isolated open portion of the tubular member. In most cases the initial placement of the packer will be near the most downhole end of the well bore in order to maximize the pressure gradient between drive fluid and the formation, thereby facilitating early communication and petroleum production. The ratio of produced petroleum to drive fluid is monitored at the wellhead to recognize an indication of excessive pass-through of the drive fluid and, based on the monitored ratio, the diverter is moved within the tubular member to optimize the petroleum production rate and to minimize the drive fluid passthrough.

The diverter may be attached to the inner conductor to be movable back and forth within the outer tubing to maximize both the heating of the formation and the movement of the heated viscous petroleum into the producer well. In the event of an unwanted breakthrough of the drive fluid through the formation into the production portion of the well, the diverter can be moved to another location within the tubular member so as to maintain a desired formation heating and petroleum movement as the breakthrough heals.

A third hollow conductor is placed within the inner conductor to provide a path for circulating carrier fluid for the produced petroleum and drive fluid. The third hollow conductor may also be rotatable to provide for clean-out operations within the tubular member thus avoiding blockage of the tubular member with produced sand and formation particles moved with the produced petroleum.

In the preferred form, the hot fluid which is flowed through the tubular member is steam, and the drive fluid used to promote movement of the petroleum is also steam. Under other conditions, the hot fluid and the drive fluid may be injected intermittently. The injectivity of the drive fluid into the formation is controlled to some extent by adjusting the condition of the hot fluid flowing through the tubular member. In this manner, the sweep efficiency of the drive fluid in the formation may be improved.

OBJECT OF THE INVENTION

An object of the invention is a method for producing viscous petroleum from a subsurface petroleum-containing formation using a single substantially horizontal well bore passing through the formation.

A further object of the present invention, in accord with the preceding object, is a method for heating, moving and producing viscous petroleum in a subsurface petroleum-containing formation using a concentric tubing well element within a well bore passing through the formation.

Another object of the present invention, in accord with the preceding objects, is an apparatus for use in a well bore passing through a formation containing viscous petroleum.

Further objects and features of the present invention will be readily apparent to those skilled in the art from the appended drawings and specification illustrating a preferred embodiment wherein.

DETAILED DESCRIPTION OF THE EMBODIMENTS OF THE INVENTION

Figure 1:
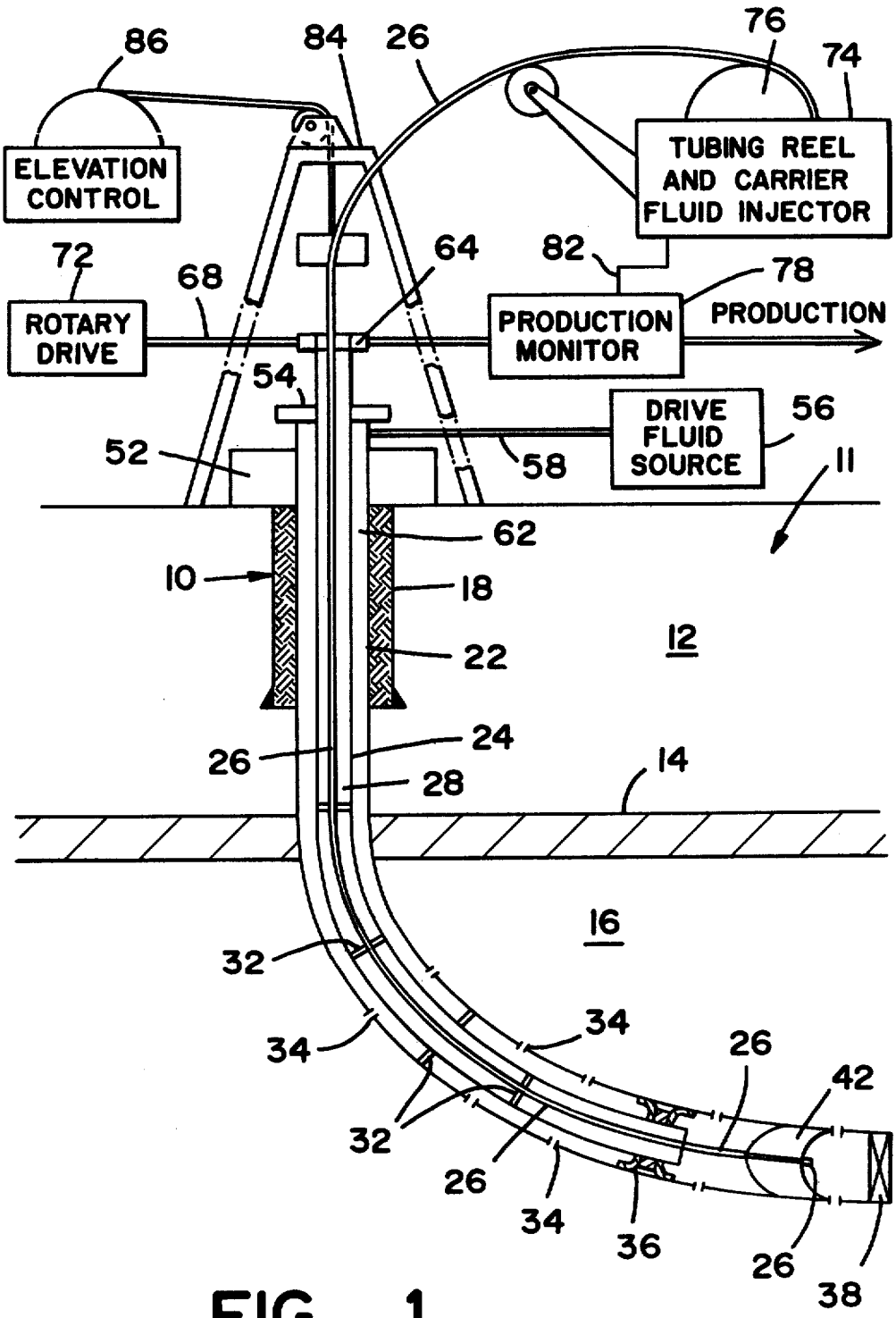
FIG. 1 is an elevational view, partially in section, illustrating one form of assembled apparatus.

Referring now to the drawings, and to FIG. 1 in particular, where the preferred embodiment of apparatus assembled in accordance with the invention is illustrated, FIG. 1 shows a well 10 drilled into an earth formation 11 having an overburden 12, an impervious layer 14 and a subsurface zone 16 containing viscous petroleum such as a tar sand. The well 10 includes an outer casing 18 cemented or completed to the formation overburden 12 and an inner casing 22 cemented to the outer casing 18. A first tubular conductor or producing string 24 is placed within the inner casing to provide a first hollow communication channel to the subsurface formations. A second tubular conductor or injection string 26 is placed within the first tubular conductor 24 to provide a second hollow communication shaft to the subsurface formations and to establish an annular space 28 between the first tubular conductor 24 and the second tubular conductor 26. Both the first and second tubular conductors are centralized within the well by suitable centralizers 32. At the downhole end of the well, the inner casing 22 is perforated at 34 in a series of places and a packer 36 is provided between the inside of the inner casing 22 and the outside of the first tubular conductor 24 in the annulus between these two members.

The bottom hole end of the inner casing 22 is completed with a cement plug 38 or other means for closing the end of the well. The bottom hole end of the second tubular conductor 26 is completed with a rotatable agitator or fishtail drill bit 42 which is adapted to be rotatable within the perforated inner casing 22 below the packer 36 and above the plug 38.

As illustrated in FIG. 1 the downhole end of the well 10 is deviated toward the horizontal to provide access to a larger horizontal portion of the zone 16 and to expose the formation surrounding the well to the heat from the fluids transported through the well and into the formation.

At the earth's surface the well is supplied with a wellhead 52 completing the outer casing 18 and the exterior of the inner casing 22. The wellhead is provided with a cap 54 permitting both rotational and longitudinal movement of the first tubular member 24, and the second tubular member 26 within that first tubular member, so that the concentric inner string of the two tubular members can be both rotated and inserted or withdrawn from the subsurface well. Below the cap 54 at the wellhead 52 a connection is made from a fluid drive source 56 through a conductor 58 to the annulus 62 between the inner casing and the tubular member 24.

The upper end of the first tubular conductor 24 is completed with a second cap 64 which provides for rotary and longitudinal movement of the tubular conductor 26. The cap 64 also provides a fluid communication channel through conductor 66 from the annulus 28 between the first and second tubular conductors and is adapted to introduce rotational drive to the first tubular conductor 24 through shaft 68 from rotary drive 72. The position of the inner conductor 26 within the well is controlled by mechanism 74 which contains a reel 76 onto which the tubing 26 may be reeled and a means for injecting carrier fluid. The production of fluid through the conductor 66 is monitored by production monitor 78 to provide communications to the mechanism 74 through mechanical or electrical connection 82.

The movable portions of the wellhead are supported on a derrick 84 having suitable elevation control mechanisms 86 for raising or lowering the tubular members into and out of the well.

Figure 2:
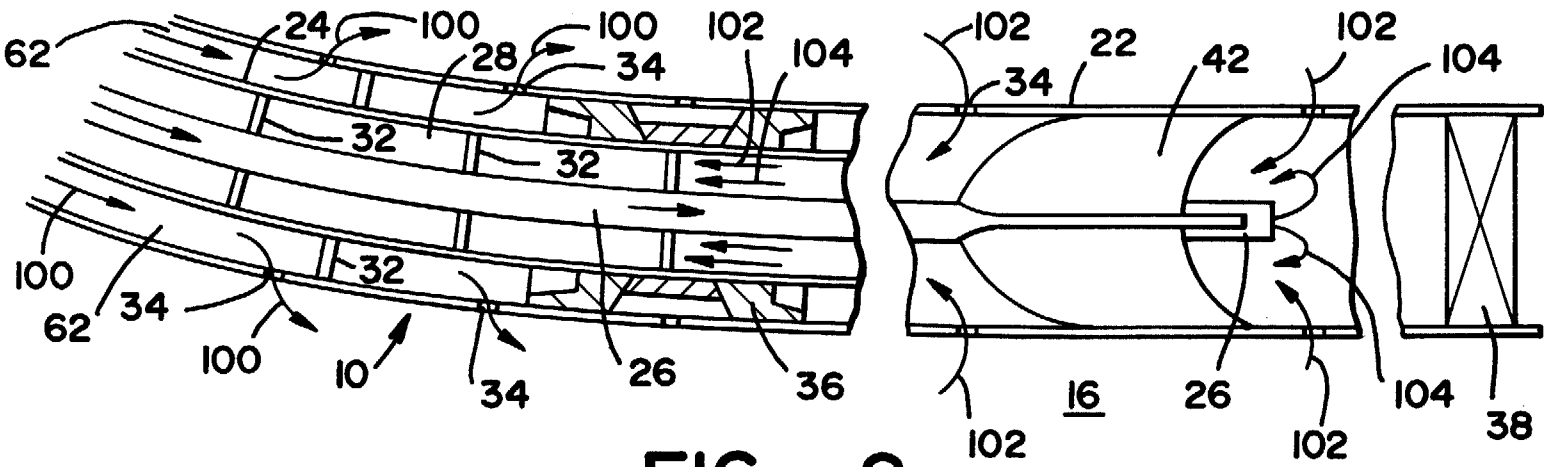
FIG. 2 is a cross-sectional view through a subsurface earth formation illustrating injection, production, and lifting paths in accord with the method of the present invention.
Figure 3:
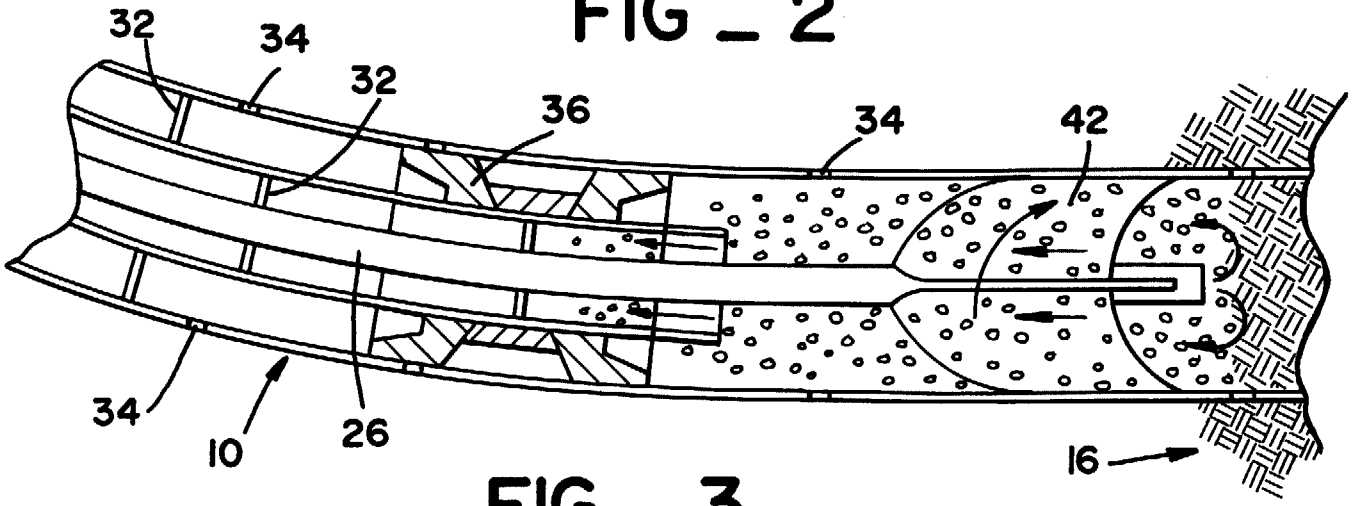
FIG. 3 is a cross-sectional view similar to FIG. 2 and illustrating a method of operation in accord with the present invention in a manner to remove particulate material from the subsurface well bore.

FIGS. 2 and 3 provide an enlarged view of the subsurface, and generally horizontal, portion of the well 10 in the subsurface zone 16. The packer 36 is movable with the first tubular conductor 24 into and out of the well independently of the second tubular conductor 26. In the same respect, the second tubular conductor is movable independently into and out of the well, below the packer 36 and above the plug 38. The inner tubular conductor 26 is rotatable to agitate materials within the well and below the packer 36 should such materials be produced with the fluid that moves into the perforations 34.

The apparatus illustrated in FIGS. 1 through 3 is adapted to complete the subsurface well and to be useful in the performance of the method of the present invention. It should be understood that other forms of apparatus to accomplish the same purposes are contemplated in accordance with the present disclosure. The apparatus itself permits the method of the present invention to be performed within the subsurface formations where viscous petroleum and/or tar sands may be produced if the petroleum deposits may be heated to increase their viscosity to permit them to flow through the formations and into the perforations of the well bore. For that purpose, the well construction and surface equipment of the present invention is adapted to provide for the flow of a drive fluid down through the annulus 62 in the path of the arrow generally shown at 100 and out the perforations 34 to accomplish heating of the formation 16 in the areas near, to and surrounding the well bore. As the formation petroleum is heated, it is moved by the drive fluids passing out through the perforations 34 to establish production of the mobile petroleum generally along the arrows 102 into the perforated inner casing 22 below the packer 36 and into the annulus space 28 between the inside of the first tubular conductor 24 and the second tubular conductor 26. Because the viscous petroleum still is under little subsurface pressure, it will probably not flow to the surface under its own pressure, and, for that reason a carrier fluid is pumped down the inside of the second tubular conductor 26 and out through the bottom hole end of that conductor, as shown by arrows 104, to mix with the produced petroleum to force the mixture of the carrier fluid 104 and production 102 up through the annulus 28. At the wellhead the produced carrier fluid and viscous petroleum are monitored by the production monitor 78 with the production going to a pipeline or storage system and, if possible, the separated carrier fluid being returned to the injector system 74.

The production monitor 78 is adapted to analyze the produced fluid to determine when excessive pusher fluid 100 is passing in through the perforations at the downhole end of the well, as well as sensing the quantity of carrier fluid being produced at the surface. From that analysis it is possible to determine whether the drive fluid has begun to breakthrough the formation. If breakthrough occurs, the packer 36 is moved to another location along the well bore to cause the drive fluid to be injected into formations where the viscous petroleum has been heated to a mobile form thus forcing the produced fluids into the perforations at the lower end of the well and to maximize the production of viscous petroleum without excessive amounts of pusher fluid.

The subsurface apparatus is provided with the agitator or fishtail drill bit 42 to provide a means for removing the produced subsurface formation materials which may have passed through the perforations 34 along with the viscous petroleum. It has been known, particularly in the case of the tar sands, that the sand material is produced with the formation petroleum and that, as the sands are deposited within the subsurface well, the well becomes clogged and the petroleum can no longer be produced through the well. For the purpose of removing such formation materials, the drill bit 42 is placed at the downhole end of the second tubular conductor 26 and is adapted to be rotated within the first tubular conductor 24 to agitate the material which may have been deposited in the well bore. At the same time the carrier fluid can be injected through the inner conductor 26 to carry this formation sand or other materials to the earth surface for removal from the well.

One suitable form for accomplishing the removal of sands from the formation is to inject through the inner conductor 26 a stabilized foam. Such foam has superior lifting qualities for carrying the subsurface formation materials to the earth surface. The process of accomplishing that removal is described in U.S. Pat. No. 3,583,483, issued in the name of Robert W. Foote, for Method For Using Foam In Wells and assigned to the same assignee as the present application.

While certain preferred embodiments of the invention have been specifically disclosed, it should be understood that the invention is not limited thereto as many variations will be readily apparent to those skilled in the art and the invention is to be given its broadest possible interpretation within the terms of the following claims.

What is claimed is:

1. A method for assisting the recovery of viscous petroleum from a subsurface petroleum-containing zone comprising:

(a) directionally drilling a well from the earth's surface into said subsurface petroleum-containing zone to position said well within said zone in a generally horizontal position;

(b) casing said well and perforating said casing at least in said generally horizontal portion thereof;

(c) placing a first tubular conductor within said casing and positioning the downhole end of said first tubular conductor adjacent to said perforations in said casing in said petroleum-containing zone nearest to the earth's surface end of said casing;

(d) injecting a hot fluid through said first tubular conductor into said perforated casing so as to heat said viscous petroleum adjacent to said perforated casing and to increase the mobility of said viscous petroleum to cause said heated viscous petroleum to flow into said casing through said perforations therein;

(e) placing a second tubular conductor within said first tubular conductor and positioning the downhole end of said second tubular conductor generally adjacent to the downhole end of said casing;

(f) placing a diverter between said casing and said first tubular conductor downhole from at least some of said perforations;

(g) injecting a driving fluid between said casing and said first tubular conductor and out of said at least some of said perforations to force said viscous petroleum toward said downhole end of said first tubular conductor;

(h) driving said viscous petroleum with said driving fluid toward said downhole end of said first tubular conductor;

(i) injecting a carrier fluid through said second tubular conductor to flow up to the earth's surface in the annular space between the inside of said first tubular conductor and the outside of said second tubular conductor, said flowing carrier fluid carrying said heated viscous petroleum to the earth surface.

2. The method of claim 1 with the additional steps of monitoring said flowing carrier fluid and said produced viscous petroleum and controlling the flow of said carrier fluid through said second tubular conductor to maximize the production of said viscous petroleum.

3. The method of claim 2 with the additional steps of attaching said diverter to said first tubular conductor and positioning said downhole end of said first tubular conductor adjacent to other perforations in said casing closer to the downhole end of said casing in accordance with the monitored production of said carrier fluid and said produced heated viscous petroleum.

4. The method of claim 3 with the additional step of attaching a means for agitating to the downhole end of said first tubular conductor and rotating said first tubular conductor while moving said first tubular conductor within said casing adjacent to said perforations therein to loosen any subsurface materials produced through said perforations, and flowing said loosened subsurface materials to the earth's surface through said casing.

5. The method of claim 4 with the additional step of passing a foamed fluid through said second tubular conductor to carry subsurface materials produced through said perforations in said casing to the earth's surface.

* * * * *